US005880700A

United States Patent [19]

Brault

[11] Patent Number: 5,880,700

[45] Date of Patent: Mar. 9, 1999

[54] ANTENNA RADOME WITH DEVICE FOR THE REMOVAL OF STREAMING WATER

[75] Inventor: Daniel Brault, Montigny-Les-Cormeilles, France

[73] Assignee: Thomson-CSF, Paris, France

[21] Appl. No.: 814,582

[22] Filed: Mar. 10, 1997

[30] Foreign Application Priority Data

Mar. 12, 1996 [FR] France ..... 96 03086

[51] Int. Cl.[6] ..... H01Q 1/42

[52] U.S. Cl. ..... 343/872; 52/11

[58] Field of Search ..... 343/872; 52/11

[56] References Cited

U.S. PATENT DOCUMENTS

| | | | |
|---|---|---|---|
| 3,569,978 | 3/1971 | Smith | 343/872 |
| 4,757,316 | 7/1988 | Brault et al. . | |
| 5,015,962 | 5/1991 | Brault et al. . | |
| 5,195,281 | 3/1993 | Kosko | 52/11 |
| 5,333,417 | 8/1994 | Demartini | 52/11 |
| 5,653,068 | 8/1997 | Moody et al. | 52/97 |

OTHER PUBLICATIONS

Patent Abstracts of Japan, vol. 13, No. 110, Mar. 16, 1989, JP63283204, Nov. 21, 1988.

Patent Abstracts of Japan, vol. 12, No. 167, May 19, 1988, JP62274903, Nov. 28, 1987.

"Rain–Blowing Plenum for Antenna Feed Horn", NTIS Tech Notes, (1991), p. 312.

Kondou, et al., "Radiation Characteristics of Reflector Antenna with Radome at 10–30 $Gh_z$ in Rainy Conditions", Electronics and Communications in Japan PartI: Communications, vol. 70, No. 8, (1987), pp. 119–126.

*Primary Examiner*—Don Wong
*Assistant Examiner*—Hoang Nguyen
*Attorney, Agent, or Firm*—Oblon, Spivak, McClelland, Maier & Neustadt, P.C.

[57] ABSTRACT

The disclosure relates to radioelectrical antennas and more particularly to the radomes for such antennas. The external face of the radome is fitted out with a device for the removal of streaming water that comprises gutters inclined downwards so as to recover the streaming water and remove it towards the lateral edges of the radome. A device of this kind prevents the collection of water towards the bottom of the antenna. The thickness of this collection of water has a detrimental effect on the precision of the orientation of the antenna pattern. Application in particular to antenna radomes for aircraft landing assistance elevation stations or for plane radar antennas.

5 Claims, 3 Drawing Sheets

FIG. 1
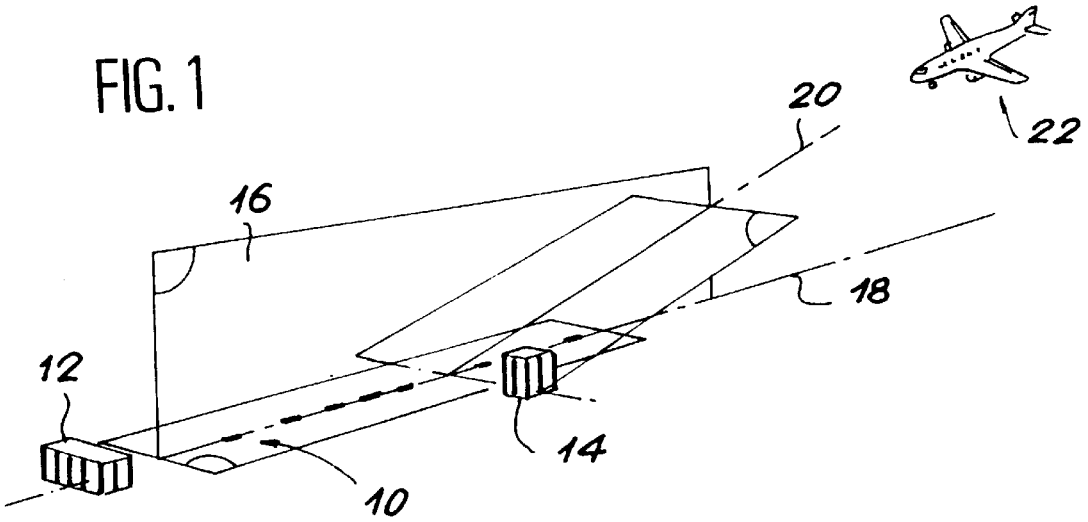
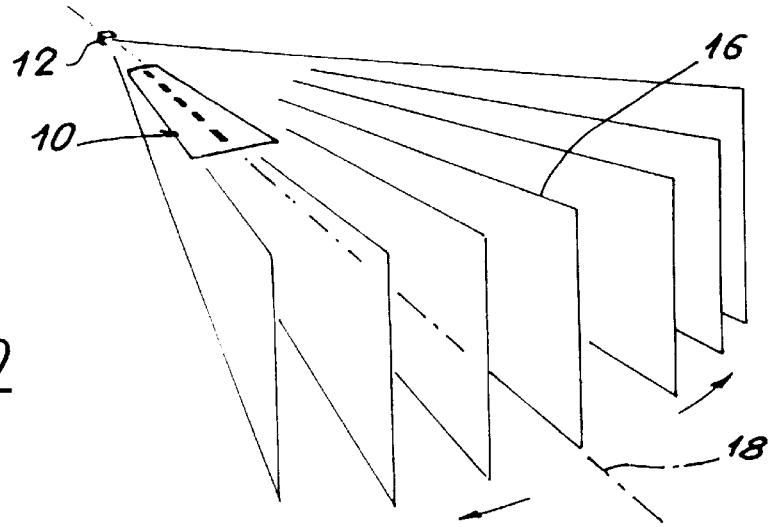
FIG. 2
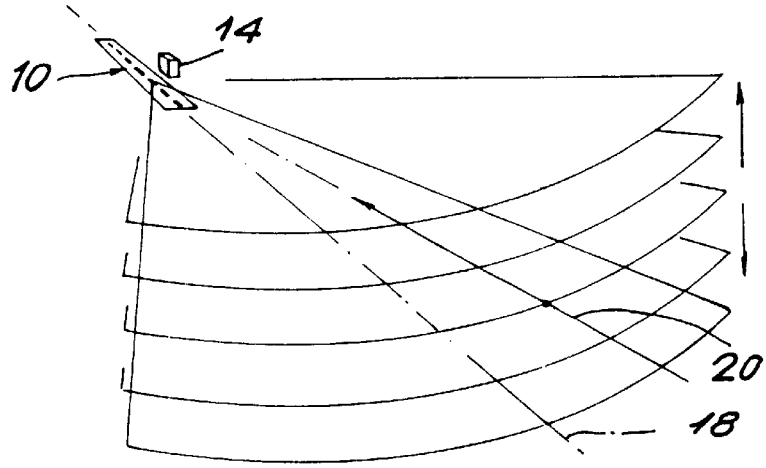
FIG. 3

FIG. 4
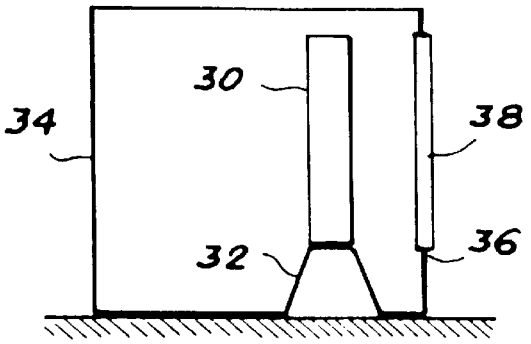
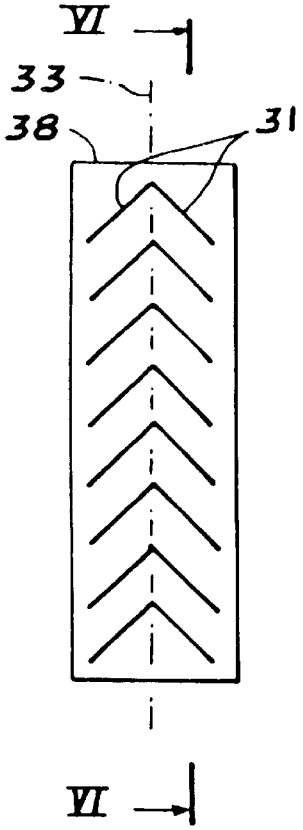
FIG. 5
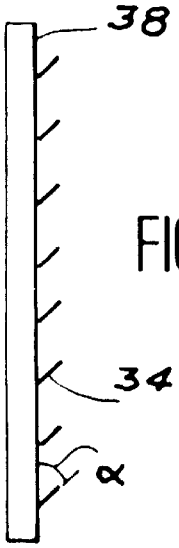
FIG. 6
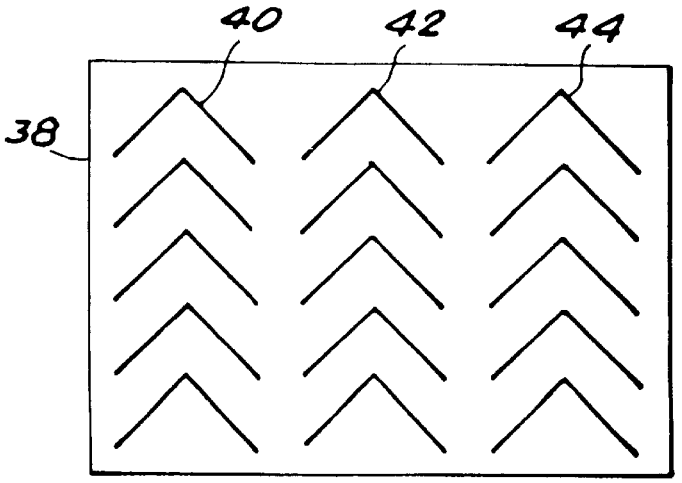
FIG. 8

ANTENNA RADOME WITH DEVICE FOR THE REMOVAL OF STREAMING WATER

BACKGROUND OF THE INVENTION

The invention relates to radioelectrical antennas and more particularly in such antennas to the electromagnetic window called the radome exposed to atmospheric conditions and crossed by radioelectrical waves.

The problem that is resolved by the invention shall be explained in the context of a radome for an antenna used in a system for landing assistance for aircraft 22 (FIG. 1), a system better known as the MLS or microwave landing system.

A landing assistance system of this kind for a runway 10 comprises (FIG. 1) an azimuth station 12 placed at the end of a track along its axis 18 and an elevation station 14 placed slightly after the beginning of the runway to the side.

The azimuth station 12 sends out radioelectrical waves in a radiation pattern in the vertical plane that shifts in azimuth between −40° and +40° with respect to the vertical plane 16 containing the axis 18 of the runway 10. This shift is achieved in proportion to time in steps of five-thousandths of a degree. This is shown by the drawing of FIG. 2 for a small number of steps;

The elevation station 14 too sends out radioelectrical waves but does so according to a radiation pattern that shifts in elevation angle from 0.9° to 15° in proportion to time in steps of five-thousandths of a degree. This is shown in the drawing of FIG. 3 for a small number of steps. One of these radiation patterns in elevation contains the axis 20 of descent of the aircraft 22 towards the landing point on the runway 10. The values of the steps that have been indicated here above by way of an example show the precision with which the positions of the different planes of radiation must be known, in such a way that all causes of error must be eliminated.

One of these causes of error is rain which streams down the radome of the antenna of the elevation station 14. For, an elevation station of this kind is formed by an emission antenna 30 (FIG. 4) positioned on a pedestal 32. This antenna is placed in a shelter 34 that contains the emitter and its control elements which are not shown. The lateral side of the shelter 34 facing the antenna 30 has an aperture 36. In this aperture 36, there is placed a plate 38 that is transparent to the radioelectrical waves emitted by the antenna. This plate is called a radome. For example, the dimensions of such a radome for an elevation station are 1.20 m in width and 4 m in height.

With a radome height of this kind it will be understood that, in the event of heavy rain (storms), the water that streams from the top to the bottom of the radome has a thickness that increases as and when the base of the radome is approached. This modifies the overall characteristics of the radome. This sheet of water, which is thicker at the bottom than at the top, constitutes a sort of prism or electromagnetic lens that has two types of effects on the radioelectrical waves that cross it:

- the introduction between the top and bottom of the radome of a phase gradient achieving an undesirable transfer function applied to the phase relationship of the antenna;
- the homogeneous mismatching and attenuation of the radome creating standing waves between the radome and the antenna and modifying the relationship of distribution of the antenna.

These disturbances affect the performance characteristics of the antenna chiefly with respect to three parameters:

- the aiming precision of the beam,
- the revival of minor lobes in the antenna pattern,
- the gain of the antenna.

SUMMARY OF THE INVENTION

The aim of the present invention therefore is to make a radome that does not have any phenomenon of collection of rain water.

The aim is achieved by fitting out the radome with a device for the removal or drainage of running water so as to prevent this water from collecting at certain points of the radome.

The invention therefore relates to a radioelectrical antenna radome wherein the face of the radome exposed to atmospheric conditions is fitted out with a device for the removal of water so as to prevent the difference in the thickness of the sheet of water running down said surface from disturbing the transmission of the radioelectrical waves through the radome.

In a preferred exemplary embodiment, this evacuation device is formed by drainage channels or gutters that remove the water towards the edges of the radome.

BRIEF DESCRIPTION OF THE DRAWINGS

Other features and advantages of the present invention shall appear from the following description of an exemplary embodiment of the invention, this description being made with reference to the appended drawings, of which:

FIG. 1 is drawing showing an aircraft runway fitted out with a landing assistance system, FIG. 2 is a drawing showing different vertical planes of radiation of the azimuth station, FIG. 3 is a drawing showing different planes of radiation of the elevation station, FIG. 4 is a schematic sectional view of an elevation station positioned in its shelter, FIG. 5 is a front view of a radome fitted out with a device for the removal of streaming water according to the present invention, FIG. 6 is a sectional view of the radome of FIG. 5 along the line VI—VI, FIG. 8 is a front view of an example of very wide radome with several columns of gutters for the removal of streaming water.

In the different Figures, the identical references designate identical elements.

MORE DETAILED DESCRIPTION

FIGS. 1 to 4 which have been described in the introduction to explain the problem solved by the invention shall not be described again.

The radome 38 in FIGS. 5 and 6 is fitted out on its radiating face, which is exposed to atmospheric conditions, with a device for the removal of streaming water. This device comprises gutters 31 inclined towards the bottom with respect to a horizontal axis. More specifically, each gutter starts from the vertical axis 33 of the radome and diverges towards a lateral edge along a descending slope. The gutters thus form chevrons oriented so as to be pointed towards the top of the radome and superimposed throughout the height of the radome. The slope of the gutters is for example 45° and their spacing is for example 50 cm.

Each gutter is formed for example by a strip 34 made of dielectric material such as polycarbonate that is bonded to the radome by the edge throughout its length. To form a gutter, each strip 34 forms an acute angle with the plane of the radome, as can be seen in FIG. 6, and it is this acute-angled feature that channels the streaming water. By their material and their 45° tilt, the gutters and the water that they channel present only one obstacle to the radioelectrical waves. This is an obstacle of low opacity. It is spread and distributed throughout the surface of the radome, and does not hinder the vertical polarization of the electromagnetic wave, any more than it hinders its horizontal polarization.

The chevron-shaped gutters shown in FIGS. 5 and 6 are given by way of an example. In fact, according to the invention, the radome on its radiating face has several tilted gutters so as to even out the thickness of the sheet of water produced by arranging the flow of water in elementary sheets. An arrangement of this kind is obtained for example by the embodiment described with reference to FIGS. 5 and 6. Other embodiments are however possible. The embodiments referred to hereinafter are given as an example and are not exhaustive. Instead of having the shape of chevrons, the gutters may have the form of simple inclined segments, positioned one on top of the other and, for example, in several columns. The abovementioned segments may also for example be replaced by arcs of circles.

Figure 7A:
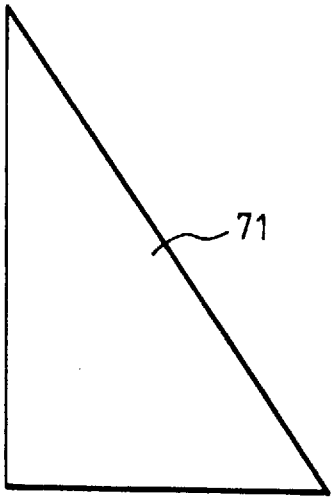
FIGS. 7*a* and 7*b* illustrate the function of the flowing device of the radome according to the invention.
Figure 7B:
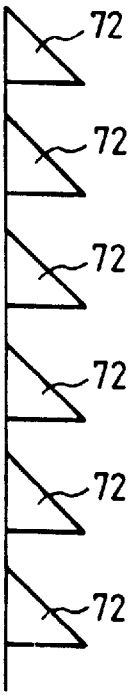

FIGS. 7*a* and 7*b* illustrate the control of the thickness of the sheet of water achieved by the device for the flow of water for a radar according to the invention. FIG. 7*a* shows the flow of a sheet of water 71 along the radiating face of a radome without a flow device. This sheet produces a prism effect by its difference of thickness and thus disturbs the electromagnetic radiation. FIG. 7*b* illustrates an arrangement of the flow of water along the radiating face of the radome in elementary sheets 72 obtained by a water flow device according to the invention. This arrangement into elementary sheets destroys the above-mentioned prism effect and the electromagnetic radiation is no longer disturbed. Indeed, the difference in thickness of each elementary sheet is negligible with respect to this radiation.

Measurements made have shown that the disturbance given by the water removal device according to the invention has no effect on the radiation or at least cannot be measured.

Moreover, in the event of heavy rain during storms, the angular drifts which, without the water removal device according to the invention, could reach values in the range of 15/100 degree have been reduced through the device to values of less than 2/100 degree.

In the case of a radome with a width of several meters, the device according to the invention would have several columns of chevrons 40, 42 and 44 as shown in the front view given by FIG. 8 where the gutters have for example the shape of chevrons. In this case, the distance between each column of chevrons and the next one will be determined so that the interval between adjacent columns is located at a place where there is a low density of radioelectrical waves so as to limit any disturbances.

What is claimed is:

1. A radioelectrical antenna radome, comprising:

a radiating face having a height; and a water removal device comprising plural inclined gutters superimposed vertically along the height of the radiating face, said gutters arranging flow of water on said radiating face into elementary sheets so as to even out a thickness of a sheet of water.

2. A radome according to claim 1, wherein each gutter comprises a strip that is bonded by an edge to said face of the radome and is oriented to form a channel for the flow of water.

3. A radome according to claim 1, wherein the gutters, in sets of two, form chevrons whose peak is pointed towards the upper part of the radome.

4. A radome according to claim 1, wherein the removal device comprises several columns of gutters.

5. A radome according to claim 1, wherein the gutters are substantially inclined by 45°.

* * * * *